US011713758B2

(12) United States Patent
Ishii

(10) Patent No.: US 11,713,758 B2
(45) Date of Patent: Aug. 1, 2023

(54) VANED PUMP DEVICE HAVING FLUID PRESSURE CHAMBERS LOCATED OUTSIDE THE CAM RING TO CONTROL CAM RING ECCENTRICITY

(71) Applicant: HITACHI AUTOMOTIVE SYSTEMS, LTD., Hitachinaka (JP)

(72) Inventor: Tetsuya Ishii, Atsugi (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 329 days.

(21) Appl. No.: 16/967,204

(22) PCT Filed: Dec. 12, 2018

(86) PCT No.: PCT/JP2018/045597
§ 371 (c)(1),
(2) Date: Aug. 4, 2020

(87) PCT Pub. No.: WO2019/155758
PCT Pub. Date: Aug. 15, 2019

(65) Prior Publication Data

US 2021/0048025 A1 Feb. 18, 2021

(30) Foreign Application Priority Data

Feb. 6, 2018 (JP) ..... 2018-018924

(51) Int. Cl.
*F04C 14/22* (2006.01)
*F04C 2/344* (2006.01)
(Continued)

(52) U.S. Cl.
CPC ..... *F04C 14/226* (2013.01); *F04C 2/344* (2013.01); *F04C 2/3442* (2013.01);
(Continued)

(58) Field of Classification Search
CPC ..... F04C 14/226; F04C 2/344; F04C 2/3442; F04C 2210/206; F04C 2240/20;
(Continued)

(56) References Cited

U.S. PATENT DOCUMENTS 6,280,150 B1 * 8/2001 Miyazawa ..... F04C 14/26 417/220
6,709,242 B2 * 3/2004 Watanabe ..... F04C 14/226 417/220
(Continued)

FOREIGN PATENT DOCUMENTS

JP 2000-104673 A 4/2000
JP 2002-168179 A 6/2002
(Continued)

OTHER PUBLICATIONS

English Abstract of JP2000104673A via SEARCH (Year: 2000).*
(Continued)

*Primary Examiner* — Dominick L Plakkoottam
*Assistant Examiner* — Paul W Thiede
(74) *Attorney, Agent, or Firm* — Foley & Lardner LLP

(57) ABSTRACT

A cam ring is capable of moving while rolling on a cam support surface. The cam ring is provided such that within a range in which the cam ring can move on the cam support surface, an eccentricity amount increasing-side angle is always greater than an eccentricity amount decreasing-side angle. On a plane perpendicular to the rotation axis of a driving shaft, the eccentricity amount increasing-side angle is an angle, in a direction opposite to a rotation direction of the driving shaft, from a first reference line, which connects a tangent point between the cam ring and the cam support surface to a rolling center of the cam ring, to a starting end of a first discharge port. The eccentricity amount decreasing-side angle is an angle, in the rotation direction of the drive
(Continued)

shaft, from the first reference line to a terminal end of the first discharge port.

7 Claims, 4 Drawing Sheets

(51) Int. Cl.
*F04C 29/06* (2006.01)
*F04C 15/00* (2006.01)
*F01C 21/10* (2006.01)

(52) U.S. Cl.
CPC ..... *F04C 14/223* (2013.01); *F01C 21/108* (2013.01); *F04C 15/0049* (2013.01); *F04C 29/06* (2013.01); *F04C 2210/206* (2013.01); *F04C 2240/20* (2013.01); *F04C 2240/30* (2013.01); *F04C 2250/30* (2013.01); *F04C 2270/185* (2013.01)

(58) Field of Classification Search
CPC ..... F04C 2240/30; F04C 2250/30; F04C 2270/185; F04C 14/223; F04C 15/0049; F04C 29/06; F01C 21/108
See application file for complete search history.

(56) References Cited

U.S. PATENT DOCUMENTS 7,318,705 B2 * 1/2008 Uchino ..... F01C 21/108 417/220
7,931,450 B2 * 4/2011 Ueki ..... F04C 15/0034 417/220
2005/0019174 A1 1/2005 Uchino

FOREIGN PATENT DOCUMENTS

JP 2005-42675 A 2/2005
JP 2012-12977 A 1/2012
JP 2016-98802 A 5/2016

OTHER PUBLICATIONS

English Translation of JP2000104673A via Espacenet (Year: 2000).*
English Abstract and English Machine Translation of JP2012012977A via Espacenet (Year: 2012).*
International Search Report issued in corresponding application No. PCT/JP2018/045597 dated Feb. 19, 2019 with English translation.
Written Opinion issued in corresponding application No. PCT/JP2018/045597 dated Feb. 19, 2019 with English translation.

* cited by examiner

VANED PUMP DEVICE HAVING FLUID PRESSURE CHAMBERS LOCATED OUTSIDE THE CAM RING TO CONTROL CAM RING ECCENTRICITY

TECHNICAL FIELD

The present invention relates to a pump device.

BACKGROUND ART

Patent Document 1 discloses a variable displacement vane pump that includes vanes retractably stored in slits of a rotor and is structured to vary a displacement of a pump chamber defined by the vanes, an outer periphery of the rotor, and an inner periphery of a cam ring. The cam ring is biased by a spring, in a direction to increase the displacement of the pump chamber.

PRIOR ART DOCUMENT(S)

Patent Document(s)

Patent Document 1: JP 2016-98802 A

SUMMARY OF THE INVENTION

Problem(s) to be Solved by the Invention

However, the conventional art described above has a problem in structural complexity because of necessity to secure a container space for the spring.

In view of the foregoing, it is desirable to provide a pump device structured without a spring for biasing of a cam ring.

Means for Solving the Problem(s)

According to an embodiment of the present invention, a pump device includes a cam ring, wherein: the cam ring is structured to be movable in a pump element container space rollingly on a cam supporter surface, due to a pressure difference between a first fluid pressure chamber and a second fluid pressure chamber and due to a pressure of hydraulic fluid in a discharge region, without requiring a bias force from a spring to the cam ring; and the cam ring is formed such that an eccentricity-increase-side angle is constantly greater than an eccentricity-decrease-side angle within a region within which the cam ring is movable on the cam supporter surface, where: on a plane perpendicular to a rotational axis of a drive shaft, the eccentricity-increase-side angle is an angle from a first reference line to a start end of a discharge port in a direction opposite to a rotational direction of the drive shaft, where the first reference line connects a tangent point between the cam ring and the cam supporter surface to a center of the rolling movement of the cam ring; and on the plane perpendicular to the rotational axis of the drive shaft, the eccentricity-decrease-side angle is an angle from the first reference line to a terminal end of the discharge port in the rotational direction of the drive shaft.

Effect(s) of the Invention

The embodiment of the present invention serves to eliminate the spring for biasing of the cam ring.

MODE(S) FOR CARRYING OUT THE INVENTION

First Embodiment

Figure 1:
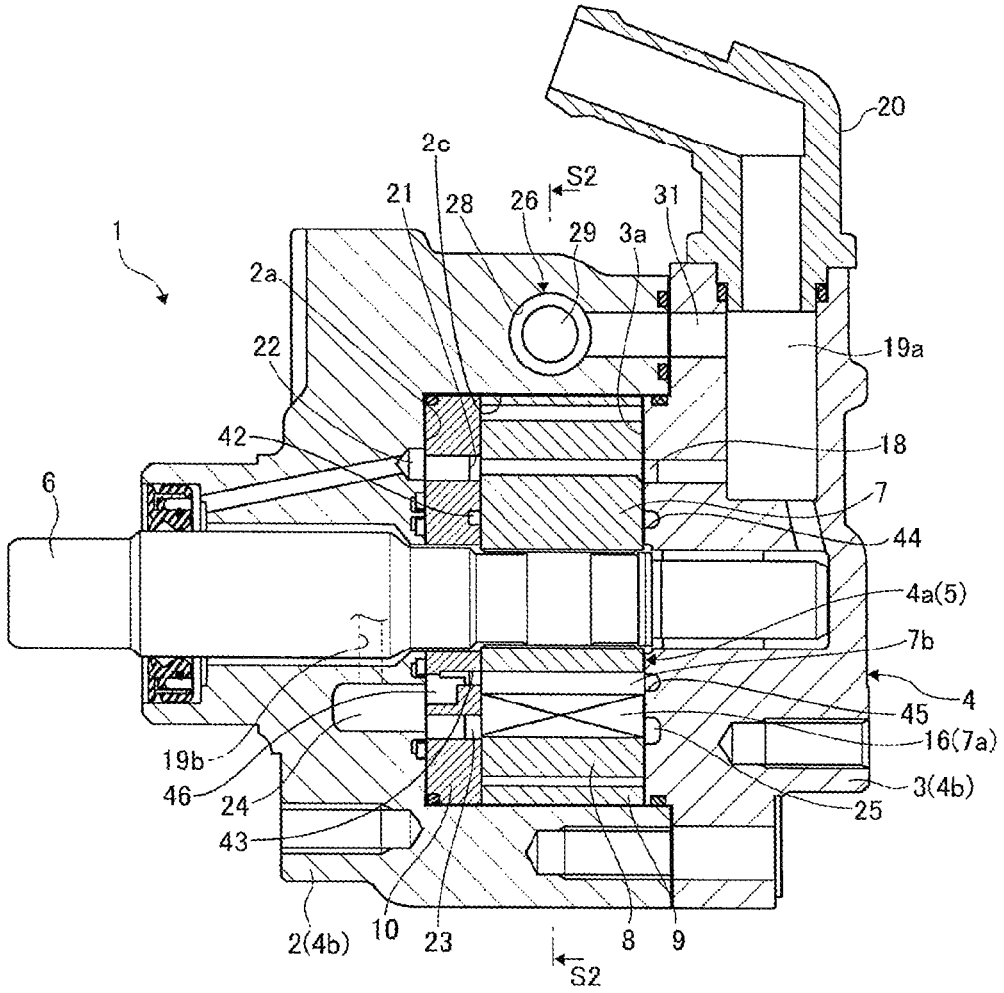
FIG. 1 is an axial sectional view of a variable displacement vane pump 1 according to a first embodiment.
Figure 2:
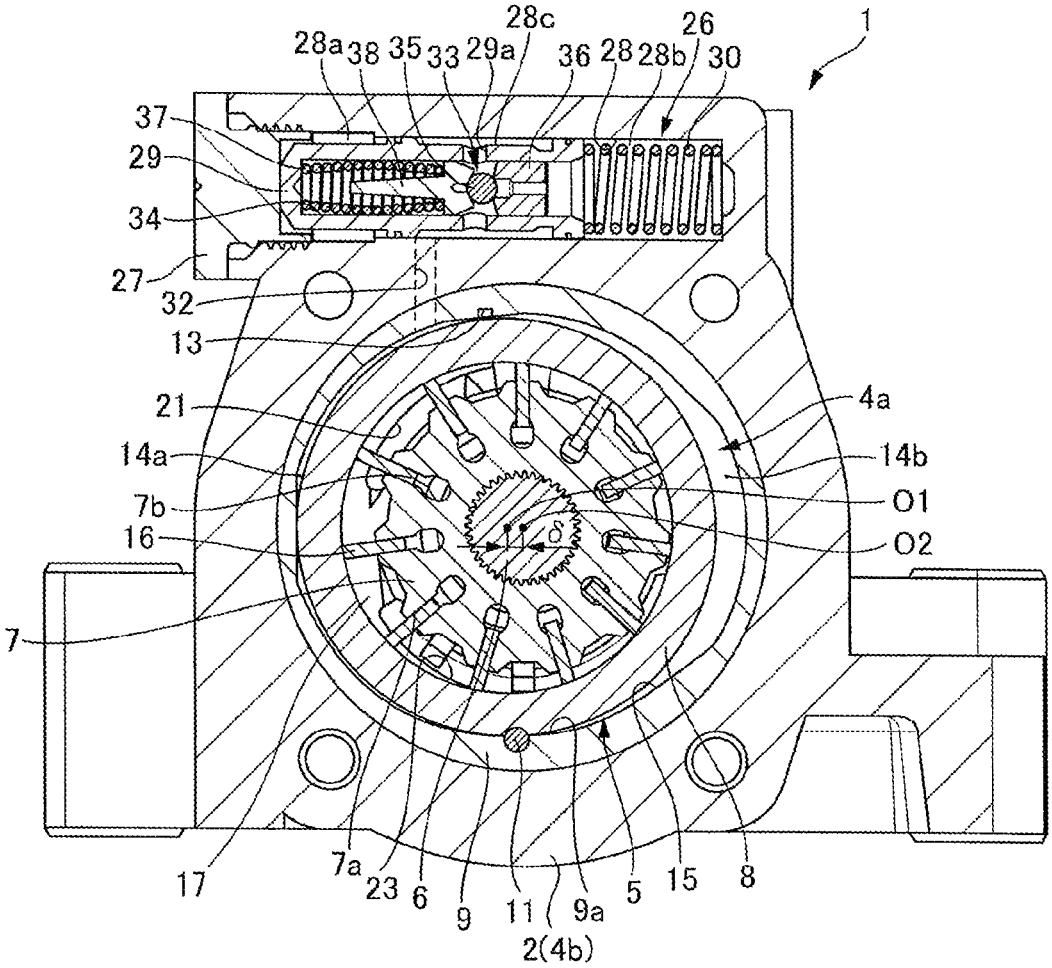
FIG. 2 is a cross sectional view along a line S2-S2 shown in FIG. 1 and in a direction of arrows beside the line S2-S2.
Figure 3:
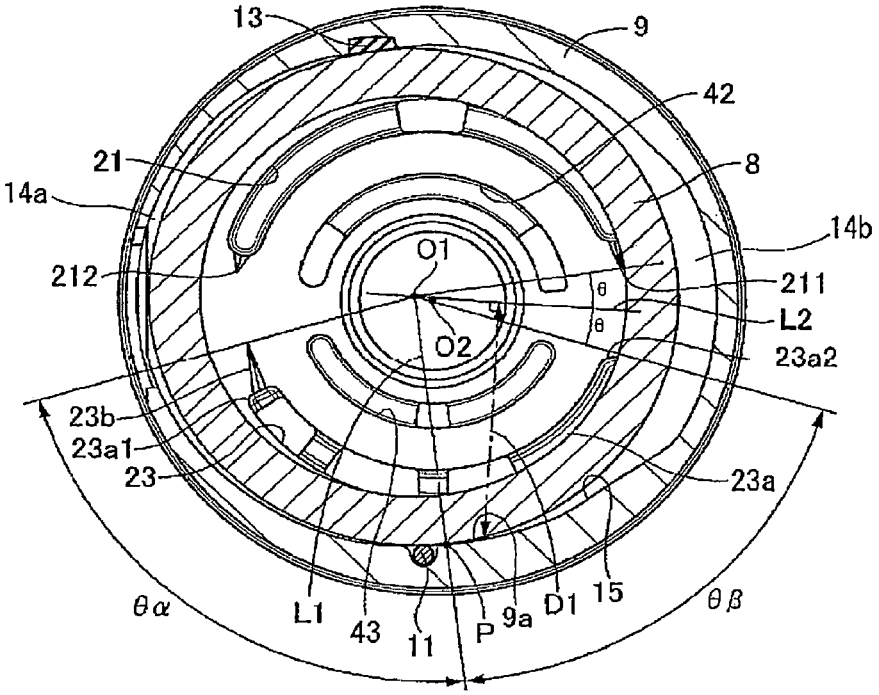
FIG. 3 is an enlarged view of a focused part of FIG. 2, excluding a rotor 7.

FIG. 1 is an axial sectional view of a variable displacement vane pump 1 according to a first embodiment. FIG. 2 is a cross sectional view along a line S2-S2 shown in FIG. 1 and in a direction of arrows beside the line S2-S2. FIG. 3 is an enlarged view of a focused part of FIG. 2, excluding a rotor 7.

Variable displacement vane pump 1 (i.e. a pump device) is structured to be disposed in an engine room of a vehicle and be used a source of oil pressure for a power steering device not shown. Variable displacement vane pump 1 includes a pump housing 4, a pump element 5, and a drive shaft 6, and is structured to perform pump action due to rotation of pump element 5 driven by drive shaft 6.

As shown in FIG. 1, pump housing 4 is made of aluminum alloy, and includes a housing body 4*b*, an adapter ring 9, and a pressure plate 10. Housing body 4*b* includes a front body 2 and a rear cover 3. Front body 2 has a shape of a bottomed cup. Rear cover 3 is bolted together with front body 2 so as to close an internal space of front body 2. Adapter ring 9 has a substantially annular shape, and is disposed inside of front body 2, and is fixed to an inner periphery 2*c* of front body 2. Pressure plate 10 has a substantially disk shape, and is disposed inside of front body 2 in contact with an inner bottom 2*a* of front body 2.

As shown in FIGS. 1 and 2, pump element 5 is contained in a pump element container space 4*a* inside of housing body 4*b*, wherein pump element container space 4*a* is surrounded by adapter ring 9, pressure plate 10, and rear cover 3. Pump element 5 includes a rotor 7 and a cam ring 8. Rotor 7 is structured to rotate together with drive shaft 6. Cam ring 8 is disposed around rotor 7, and has a substantially annular shape. Cam ring 8 is structured to roll on an inner periphery of adapter ring 9, within a predetermined region.

As shown in FIG. 2, cam ring 8 has an eccentricity $\delta$ with respect to rotor 7 which is defined based on an amount of shift from a rotational axis O2 of drive shaft 6 to a center O1 of an inner peripheral edge of cam ring 8 in a cross section perpendicular to a rotational axis of drive shaft 6. Eccentricity $\delta$ becomes maximum when the shift amount of O1 with respect to O2 becomes maximum, and becomes minimum when the shift amount becomes minimum. The following description refers to a direction along rotational axis O2 as an axial direction, and a direction of radiation from rotational axis O2 as a radial direction, and a direction around rotational axis O2 as a circumferential direction.

Adapter ring 9 includes in its inner periphery a cam supporter surface 9*a* structured to support cam ring 8 upon the rolling move of cam ring 8. Cam ring 8 is structured to move rollingly on cam supporter surface 9*a*, around center O1. Cam supporter surface 9*a* is formed linearly in the axial direction. In the inner periphery of adapter ring 9, a rotation regulator pin 11 is disposed to regulate rotation of cam ring 8. Furthermore, in the inner periphery of adapter ring 9, a seal member 13 is disposed for sealing between cam ring 8 and adapter ring 9, wherein seal member 13 is positioned substantially oppositely to rotation regulator pin 11 in the radial direction. Between cam ring 8 and adapter ring 9, a pair of fluid pressure chambers 14*a* and 14*b* are formed. First fluid pressure chamber 14*a* is formed at a side of cam ring 8 in the radial direction. Second fluid pressure chamber 14*b* is formed at another side of cam ring 8 in the radial direction. Cam ring 8 rolls on cam supporter surface 9*a* due to a pressure difference between fluid pressure chambers 14*a* and 14*b*. This causes eccentricity δ of cam ring 8 to increase or decrease.

Adapter ring 9 includes a cam ring stopper 15 that is formed in a side of second fluid pressure chamber 14*b* of the inner periphery of adapter ring 9, and is structured to be in contact with cam ring 8 when a displacement of second fluid pressure chamber 14*b* is minimum. Cam ring stopper 15 defines a minimum eccentricity of cam ring 8 with respect to rotor 7. When cam ring stopper 15 is in contact with an outer periphery of cam ring 8, cam ring stopper 15 maintains center O1 of the inner peripheral edge of cam ring 8 and rotational axis O2 of drive shaft 6 off from each other. Cam ring stopper 15 secures a minimum discharge capacity of pump chambers 17 described below, so as to suppress eccentricity δ from becoming zero. Accordingly, cam ring stopper 15 is formed to secure the minimum eccentricity of cam ring 8 with respect to rotor 7 and allow pump chambers 17 to discharge hydraulic oil or hydraulic fluid, even when cam ring stopper 15 is in contact with cam ring 8. In particular, although cam ring 8 may move in a direction to reduce eccentricity δ due to its own weight depending on which location in the vehicle the variable displacement vane pump 1 is mounted to, cam ring stopper 15 serves even in such case to secure the minimum eccentricity and thereby secure a discharge capacity at pump startup.

Figure 4:
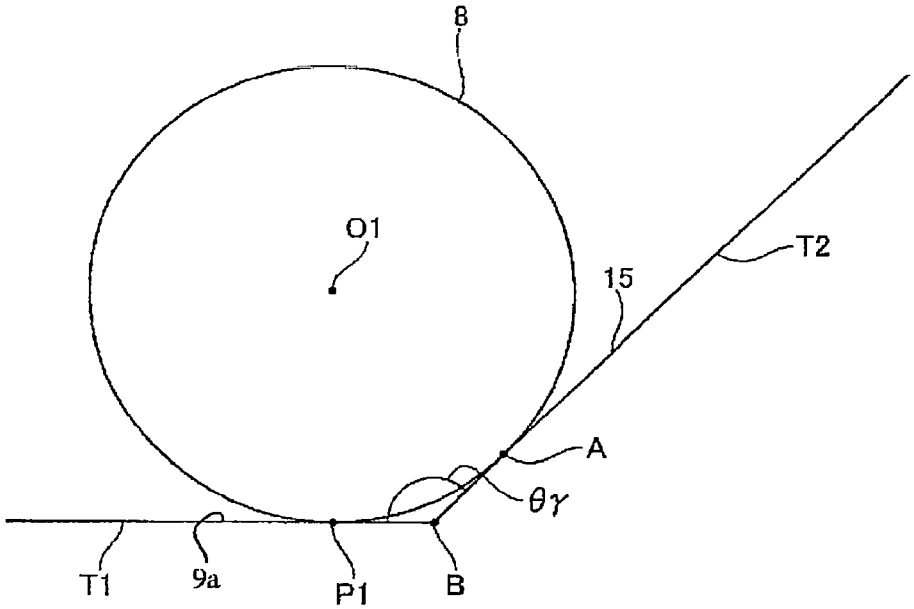
FIG. 4 is an illustrative view of a state of contact between a cam ring 8 and a cam ring stopper 15.

FIG. 4 is an illustrative view showing how cam ring 8 and cam ring stopper 15 contact with each other.

As shown in FIG. 4, when cam ring 8 is in contact with cam ring stopper 15, cam ring 8 is in contact with cam supporter surface 9*a* at a first tangent point P1, and has a first tangent line T1 tangent to an outer peripheral edge of cam ring 8 at first tangent point P1. Furthermore, cam ring 8 is in contact with cam ring stopper 15 at a second tangent point A, and has a second tangent line T2 tangent to the outer peripheral edge of cam ring 8 at second tangent point A. First tangent line T1 and second tangent line T2 crosses each other at an vertex B. According to the first embodiment, cam supporter surface 9*a* and cam ring stopper 15 are formed such that a minor angle $\theta y$ out of angles interposed by first and second line segments is an obtuse angle (i.e. $90° < \theta y < 180°$), where the first line segment is a line segment connecting the vertex B to first tangent point P1, and the second line segment is a line segment connecting the vertex B to second tangent point A.

As shown in FIG. 2, rotor 7 includes slits 7*a* each of which is formed in an outer circumferential section of rotor 7 as a notch in the radial direction. Slits 7*a* are arranged at equal intervals in the circumferential direction. Each of slits 7*a* stores a vane 16 extending in the radial direction of rotor 7, wherein each of vanes 16 is retractably stored. Each of vanes 16 serves as a partition in an annular space formed between cam ring 8 and rotor 7. This defines pump chambers 17. Each of pump chambers 17 orbitingly moves while increasing or decreasing in volume, by rotating rotor 7 by drive shaft 6 in an anticlockwise/counterclockwise direction in FIG. 2. This achieves the pump action. Each of vanes 16 is structured to be pressed on an inner periphery of cam ring 8 due to pressure from hydraulic oil introduced into a back pressure chamber 7*b* formed at an inner circumferential side of each slit 7*a*.

As shown in FIG. 1, rear cover 3 includes an inner face 3*a* facing the pump element container space 4*a*. Furthermore, rear cover 3 includes in inner face 3*a* a first suction port 18 that has in front view a substantially crescent shape extending in the circumferential direction, and is positioned in a suction region in which each of pump chambers 17 gradually increases in volume with rotation of rotor 7. First suction port 18 is in communication with a suction passage 19*a* formed in rear cover 3, wherein hydraulic oil is introduced into suction passage 19*a* via a suction pipe 20 connected to a reserve tank not shown. This allows the hydraulic oil to be sucked into each of pump chambers 17 due to pump suction effect in the suction region.

Pressure plate 10 includes a second suction port 21 that is formed in a face of pressure plate 10 facing the rotor 7, and is positioned oppositely to first suction port 18, and has a substantially crescent shape in front view similarly to first suction port 18. Second suction port 21 is in communication with a circulation passage 22 formed in front body 2. Circulation passage 22 is in communication with a cavity of front body 2, wherein the cavity contains a seal member for sealing between front body 2 and drive shaft 6. The pump suction effect in the suction region serves to supply surplus oil at the seal member to each of pump chambers 17 and thereby suppress the surplus oil from leaking outside. For convenience of explanation, the following description about the suction ports refers to second suction port 21, omitting reference to first suction port 18.

As shown in FIG. 3, pressure plate 10 includes a first discharge port 23 that has in front view a substantially crescent shape extending in the circumferential direction, and is formed in the face of pressure plate 10 facing the rotor 7, and is positioned in a discharge region in which each of pump chambers 17 decreases in volume with rotation of rotor 7. First discharge port 23 includes a discharge port main part 23*a* and a notch 23*b*. Discharge port main part 23*a* has a substantially crescent shape in front view. Notch 23*b* extends from a start end 23*a*1 toward a terminal end 212 of second suction port 21, and substantially has a shape of acute-angled triangle increasing in cross sectional area of flow channel as followed in the rotational direction of rotor 7. Start end 23*a*1 of discharge port main part 23*a* is an initial part of discharge port main part 23*a* to overlap with vane 16 that has left the suction region with rotation of rotor 7. Terminal end 212 of second suction port 21 is a last part of second suction port 21 to overlap with vane 16 moving in the suction region with rotation of rotor 7. Furthermore, discharge port main part 23*a* has a terminal end 23*a*2 formed without a notch. Terminal end 23*a*2 of discharge port main part 23*a* is a last part of discharge port main part 23*a* to overlap with vane 16 moving in the discharge region with rotation of rotor 7. Second suction port 21 has a start end 211 and the terminal end 212 each of which include a notch. Start end 211 of second suction port 21 is an initial part to overlap with vane 16 that has left the discharge region with rotation of rotor 7.

When viewed in the direction of rotational axis O2, the discharge region spreads within an angular range corresponding to a section between a start end of first discharge port 23 (i.e. a tip of notch 23*b*) and terminal end 23*a*2 of discharge port main part 23*a*. The suction region spreads within an angular range corresponding to a section between start end 211 and terminal end 212 of second suction port 21.

In addition, a region corresponding to an angular range between terminal end 212 of second suction port 21 and the start end of first discharge port 23 forms a first confinement region, and a region corresponding to an angular range between terminal end 23*a*2 of first discharge port 23 and start end 211 of second suction port 21 forms a second confinement region. The confinement regions serve to confine hydraulic oil existing in these regions so as to suppress second suction port 21 and first discharge port 23 from communicating with each other. In the first confinement region, cam ring 8 is shaped such that a minimum distance between the inner periphery of cam ring 8 and rotational axis O2 of drive shaft 6 gradually decreases with rotation of drive shaft 6.

As shown in FIG. 1, first discharge port 23 communicates with a discharge passage 19*b* via a pressure chamber 24 formed as a recess in inner bottom 2*a* of front body 2, wherein inner bottom 2*a* faces pressure plate 10. This allows hydraulic oil discharged from each of pump chambers 17 due to pump discharge effect in the discharge region, to be discharged outside of pump housing 4 via pressure chamber 24 and discharge passage 19*b*, and be sent to a hydraulic power cylinder of the power steering device. Pressure plate 10 is pressed toward rotor 7 due to a pressure in pressure chamber 24.

Rear cover 3 includes in its inner face 3*a* a second discharge port 25 that is positioned oppositely to first discharge port 23 and has a same shape as first discharge port 23. Thus, first suction port 18 and second suction port 21 are disposed axially symmetrically with respect to pump chambers 17 so as to interpose pump chambers 17 therebetween, and similarly, first discharge port 23 and second discharge port 25 are disposed axially symmetrically with respect to pump chambers 17 so as to interpose pump chambers 17 therebetween. This serves to maintain pressure balance between both sides in the axial direction of each of pump chambers 17. The following description about the discharge ports refers to first discharge port 23, omitting reference to second discharge port 25.

Pressure plate 10 includes a first suction-side back pressure port 42 and a first discharge-side back pressure port 43, in its face facing the rotor 7. First suction-side back pressure port 42 is a substantially arc-shaped groove extending circumferentially along a line inner in a radial direction of pressure plate 10 with respect to second suction port 21, and spreads in a circumferential range overlapping with second suction port 21. First discharge-side back pressure port 43 is a substantially arc-shaped groove extending circumferentially along a line inner in a radial direction of pressure plate 10 with respect to first discharge port 23, and spreads in a circumferential range overlapping with first discharge port 23. First discharge-side back pressure port 43 have circumferential ends communicating with circumferential ends of first suction-side back pressure port 42. First suction-side back pressure port 42 and first discharge-side back pressure port 43 are connected to pressure chamber 24 via a communication hole 46.

Rear cover 3 includes in its inner face 3*a* a second suction-side back pressure port 44 that is a substantially arc-shaped groove extending in the circumferential direction of rear cover 3, and is positioned oppositely to first suction-side back pressure port 42. Furthermore, rear cover 3 includes in its inner face 3*a* a second discharge-side back pressure port 45 that is a substantially arc-shaped groove extending in the circumferential direction of rear cover 3, and is positioned oppositely to first discharge-side back pressure port 43. Thus, first suction-side back pressure port 42 and second suction-side back pressure port 44 are disposed axially symmetrically so as to interpose pump chambers 17 therebetween, and similarly, first discharge-side back pressure port 43 and second discharge-side back pressure port 45 are disposed axially symmetrically so as to interpose pump chambers 17 therebetween. This serves to maintain the pressure balance between both sides in the axial direction of each of pump chambers 17.

As shown in FIG. 3, a tangent point P represents a point of contact between cam ring 8 and cam supporter surface 9*a* of adapter ring 9. A first reference line L1 represents a line connecting the tangent point P to center O1 of an inner peripheral edge of cam ring 8 which is a center of rolling movement of cam ring 8. A second reference line L2 represents a line connecting the center O1 to a middle point between terminal end 23*a*2 of first discharge port 23 and start end 211 of second suction port 21 in a circumferential direction of rotational axis O2. An eccentricity-increase-side angle $\theta\alpha$ represents an angle from first reference line L1 to the start end of first discharge port 23 (i.e. the tip of notch 23*b*) in a direction opposite to the rotational direction of drive shaft 6 that rotates in the anticlockwise direction. An eccentricity-decrease-side angle $\theta\beta$ represents an angle from first reference line L1 to a terminal end of first discharge port 23 (i.e. terminal end 23*a*2 of discharge port main part 23*a*) in the rotational direction of drive shaft 6 (i.e. the anticlockwise direction). According to the first embodiment, eccentricity-increase-side angle $\theta\alpha$ is set to be constantly greater than eccentricity-decrease-side angle $\theta\beta$ within the region within which cam ring 8 is rollingly movable on cam supporter surface 9*a*.

Cam supporter surface 9*a* is formed to tilt with respect to second reference line L2 such that a minimum distance D1 between cam supporter surface 9*a* and second reference line L2 gradually increases as followed from a side of second fluid pressure chamber 14*b* to a side of first fluid pressure chamber 14*a*.

As shown in FIG. 2, front body 2 contains in its upper end part a control valve 26 structured to control a discharge pressure of pump. Control valve 26 is disposed such that a longitudinal direction of control valve 26 is perpendicular to rotational axis O2. Control valve 26 includes a valve hole 28, a spool 29, and a control valve spring 30. Valve hole 28 includes an opening closed by a plug 27, wherein the opening is at left of valve hole 28 in FIG. 2. Spool 29 is a spool valve element substantially having a shape of bottomed cylinder, and is slidably contained in valve hole 28. Control valve spring 30 is a compression coil spring shaped cylindrical, and biases spool 29 toward plug 27.

Valve hole 28 includes a high pressure chamber 28*a*, a middle pressure chamber 28*b*, and a low pressure chamber 28*c* which are defined by spool 29. High pressure chamber 28*a* receives an oil pressure of an upstream side of a metering orifice not shown formed in discharge passage 19*b*: i.e., an oil pressure of pressure chamber 24. Middle pressure chamber 28*b* contains control valve spring 30, and receives an oil pressure of a downstream side of the metering orifice. Low pressure chamber 28*c* is formed in an outer circumference of spool 29, and receives a pump suction pressure from suction passage 19*a* via a low pressure passage 31 (see FIG. 1).

Spool 29 moves in its longitudinal direction depending on a pressure difference between middle pressure chamber 28*b* and high pressure chamber 28*a*, i.e. a difference between pressures in front and back of the metering orifice. Specifically, in case that the difference between pressures in front and back of the metering orifice is equal to or less than a predetermined value, spool 29 is in contact with plug 27. In such case, a communication passage 32 for communication between valve hole 28 and first fluid pressure chamber 14*a* is open to low pressure chamber 28*c*, so as to cause a relatively low oil pressure in low pressure chamber 28*c* to be introduced to first fluid pressure chamber 14*a*. On the other hand, in case that the difference between pressures in front and back of the metering orifice has risen over the predetermined value, spool 29 moves in a direction to recede from plug 27 over a bias force from control valve spring 30. This gradually blocks communication between low pressure chamber 28*c* and first fluid pressure chamber 14*a*, and causes high pressure chamber 28*a* to communicate with first fluid pressure chamber 14*a* via communication passage 32, and thereby causes a relatively high oil pressure in high pressure chamber 28*a* to be introduced to first fluid pressure chamber 14*a*. Thus, first fluid pressure chamber 14*a* selectively receives the oil pressure in low pressure chamber 28*c* or the oil pressure in high pressure chamber 28*a*. In contrast, second fluid pressure chamber 14*b* constantly receives the pump suction pressure, because second fluid pressure chamber 14*b* is connected to suction passage 19*a* or first suction port 18.

Spool 29 includes inside it a relief valve 33. Relief valve 33 is maintained closed in case that the pressure in middle pressure chamber 28*b* is less than a predetermined value. In case that the pressure in middle pressure chamber 28*b* has become equal to or greater than the predetermined value, i.e., in case that a pressure in a side of the power steering device (i.e. a load side) has become equal to or greater than the predetermined value, relief valve 33 opens to perform relief action and circulation of hydraulic oil to suction passage 19*a* via low pressure chamber 28*c* and low pressure passage 31. In other words, relief valve 33 is structured to open and close an oil passage between discharge passage 19*b* and suction passage 19*a*. Relief valve 33 includes a valve hole 34, a relief hole 29*a*, a ball 35, a valve seat 36, a relief valve spring 37, and a retainer 38. Valve hole 34 has a substantially cylindrical shape, and is formed in an inner circumference of spool 29. Relief hole 29*a* is formed in relief hole 29*a* so as to establish communication between valve hole 34 and low pressure chamber 28*c*. Ball 35 is a valve element disposed in valve hole 34. Valve seat 36 is a valve seat structured to contact the ball 35, and is fixed in a first axial end side of valve hole 34 with respect to face ball 35. Relief valve spring 37 is a coil spring disposed in a compression-deformed state, in a second axial end side of valve hole 34 with respect to ball 35. Retainer 38 is interposed between ball 35 and relief valve spring 37, and biases ball 35 toward valve seat 36 due to a restoring force caused by the compression deformation of relief valve spring 37.

The following describes effects of the first embodiment.

In case that rotor 7 rotates at a low speed and the difference between pressures in front and back of the metering orifice is equal to or less than the predetermined value, first fluid pressure chamber 14*a* receives the oil pressure from low pressure chamber 28*c*, and has a pressure equal to second fluid pressure chamber 14*b*. During the rotation of rotor 7, a part of cam ring 8 corresponding to the discharge region undergoes an internal pressure (i.e. a pressure in each of pump chambers 17). The internal pressure exerted on the inner periphery of cam ring 8 within an angular range of eccentricity-increase-side angle $\theta\alpha$ in the discharge region generates a force to cause cam ring 8 to rollingly move in a direction to increase the eccentricity $\delta$. On the other hand, the internal pressure exerted on the inner periphery of cam ring 8 within an angular range of eccentricity-decrease-side angle $\theta\beta$ in the discharge region generates a force to cause cam ring 8 to rollingly move in a direction to decrease the eccentricity $\delta$.

According to the first embodiment, eccentricity-increase-side angle $\theta\alpha$ is set to be constantly greater than eccentricity-decrease-side angle $\theta\beta$ within the region within which cam ring 8 is rollingly movable on cam supporter surface 9*a*. Therefore, the force to cause cam ring 8 to rollingly move in the direction to increase the eccentricity $\delta$, which is due to the internal pressure exerted on the inner periphery of cam ring 8, is constantly greater than the force to cause cam ring 8 to rollingly move in the direction to decrease the eccentricity $\delta$. Thus, the internal pressure exerted on the inner periphery of cam ring 8 constantly generates a bias force to bias the cam ring 8 in the direction to increase the eccentricity $\delta$. Accordingly, in case of the low speed rotation of rotor 7 in which first fluid pressure chamber 14*a* and second fluid pressure chamber 14*b* are equal to each other in pressure, the internal pressure exerted on the inner periphery of cam ring 8 causes cam ring 8 to move rollingly on cam supporter surface 9*a* to a position at which eccentricity $\delta$ is maximum (a left side position in FIG. 2), where the pump discharge pressure is maximum.

In case that rotor 7 rises in rotational speed and the difference between pressures in front and back of the metering orifice becomes greater than the predetermined value, first fluid pressure chamber 14*a* receives the oil pressure from high pressure chamber 28*a*. This causes cam ring 8 to rollingly move to a position at which a load due to the pressure difference between first fluid pressure chamber 14*a* and second fluid pressure chamber 14*b* is in equilibrium with a load due to the internal pressure exerted on cam ring 8. This reduces the pump discharge pressure because eccentricity $\delta$ decreases with increase in pump discharge pressure.

As described above, variable displacement vane pump 1 according to the first embodiment is formed such that eccentricity-increase-side angle $\theta\alpha$ is set to be constantly greater than eccentricity-decrease-side angle $\theta\beta$. Accordingly, the internal pressure exerted on the inner periphery of cam ring 8 during the rotation of rotor 7 generates the bias force to bias the cam ring 8 constantly in the direction to increase the eccentricity $\delta$. This establishes position control of cam ring 8 depending on balance between the load due to the pressure difference between first fluid pressure chamber 14*a* and second fluid pressure chamber 14*b* and the load due to the internal pressure exerted on cam ring 8.

This allows variable displacement vane pump 1 according to the first embodiment to be configured without a spring for biasing the cam ring 8, and serves to achieve simplification in structure and reduce a number of components by eliminating an opening for mounting the spring from outside of pump housing 4, a plug for closing the opening, an O-ring for sealing the opening, etc.

Figure 5:
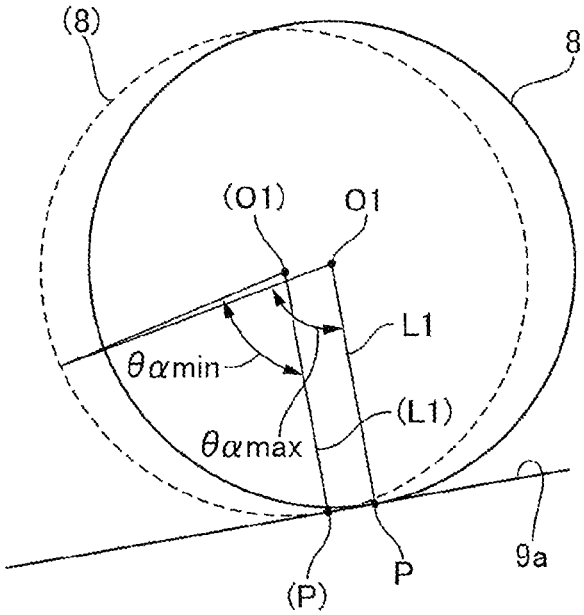
FIG. 5 is an illustrative view of relation between positioning of cam ring 8 and an eccentricity-increase-side angle $\theta\alpha$.

FIG. 5 is an illustrative view showing relation between eccentricity-increase-side angle 9*a* and positioning of cam ring 8, where: a continuous line shows a position of cam ring 8 when eccentricity $\delta$ is minimum, and a broken line shows a position of cam ring 8 when eccentricity $\delta$ is maximum.

Cam ring 8 rolls around center O1 of the inner peripheral edge of cam ring 8, and moves in pump element container space 4*a* rollingly on cam supporter surface 9*a*. Eccentricity-increase-side angle $\theta\alpha$ has a maximum value $\theta\alpha max$ when eccentricity $\delta$ is at its minimum, and decreases with increase in eccentricity $\delta$, and has a minimum value $\theta\alpha min$ when eccentricity $\delta$ is at its maximum. Thus, because of configuration that cam ring 8 rollingly moves on cam supporter surface 9*a*, the bias force to bias the cam ring 8 in the direction to increase the eccentricity δ due to the internal pressure exerted on cam ring 8 decreases with increase in eccentricity δ of cam ring 8. In particular, when eccentricity δ of cam ring 8 is maximum, the bias force due to the internal pressure is minimum. This serves to reduce a pressure of first fluid pressure chamber 14*a* which is required for biasing the cam ring 8 in the direction to decrease the eccentricity δ of cam ring 8, over the load due to the internal pressure exerted on cam ring 8. This facilitates countermeasures for leakage of hydraulic oil from first fluid pressure chamber 14*a*.

Second fluid pressure chamber 14*b* is connected to suction passage 19*a* or first suction port 18. This causes second fluid pressure chamber 14*b* to have a pressure equal to or nearly equal to the pump suction pressure. This serves to reduce a pressure of first fluid pressure chamber 14*a* which is required upon generation of the pressure difference between first fluid pressure chamber 14*a* and second fluid pressure chamber 14*b*. This facilitates the countermeasures for leakage of hydraulic oil from first fluid pressure chamber 14*a*.

Cam supporter surface 9*a* is formed to tilt with respect to second reference line L2 such that minimum distance D1 between cam supporter surface 9*a* and second reference line L2 gradually increases as followed from a side of second fluid pressure chamber 14*b* to a side of first fluid pressure chamber 14*a*. This serves to set eccentricity-increase-side angle θα greater in comparison with case that minimum distance D1 is constant or gradually decreases, and facilitates establishing the relation that eccentricity-increase-side angle θα is greater than eccentricity-decrease-side angle θβ.

Cam supporter surface 9*a* is formed linearly in the direction of rotational axis O2 of the drive shaft. This serves to simplify variation characteristics upon the decrease in eccentricity-increase-side angle θα with increase in eccentricity δ of cam ring 8 within the region within which cam ring 8 is rollingly movable on cam supporter surface 9*a*. This facilitates various adjustments for design of pump.

Notch 23*b* of first discharge port 23 extends from start end 23*a*1 of discharge port main part 23*a* to terminal end 212 of second suction port 21, in the circumferential direction around rotational axis O2 of the drive shaft, wherein eccentricity-increase-side angle θα is the angle from first reference line L1 to the start end of notch 23*b*, in the direction opposite to the rotational direction of drive shaft 6. Notch 23*b* serves to introduce the pump discharge pressure to a region in pump chambers 17 to which notch 23*b* opens. This serves to increase the eccentricity-increase-side angle θα without excessively shifting a position of discharge port main part 23*a* toward second suction port 21. This facilitates establishing the relation that eccentricity-increase-side angle θα is greater than eccentricity-decrease-side angle θβ.

Discharge port main part 23*a* has terminal end 23*a*2 formed without a notch. This serves to decrease the eccentricity-decrease-side angle θβ and thereby increase the eccentricity-increase-side angle θα. This facilitates establishing the relation that eccentricity-increase-side angle θα is greater than eccentricity-decrease-side angle θβ.

Cam ring 8 is shaped such that the minimum distance between the inner periphery of cam ring 8 and rotational axis O2 of drive shaft 6 gradually decreases with rotation of drive shaft 6, in the first confinement region between terminal end 212 of second suction port 21 and the start end of first discharge port 23 (i.e. the tip of notch 23*b*), in the space formed between cam ring 8 and rotor 7. This serves to induce a positive pressure in pump chambers 17 by so-called pre-compression profile in the first confinement region. This pressure encourages eccentricity δ of cam ring 8 to increase, and thereby serves to eliminate a deficiency in force in the direction to increase eccentricity δ of cam ring 8. This facilitates establishing the relation that eccentricity-increase-side angle θα is greater than eccentricity-decrease-side angle θβ.

Cam ring stopper 15 is formed to face the second fluid pressure chamber 14*b*, and is shaped to be in contact with cam ring 8 when the displacement of second fluid pressure chamber 14*b* is minimum. Furthermore, cam ring stopper 15 is set such that minor angle θ*y* out of angles between the first and second line segments is an obtuse angle, where: the first line segment connects vertex B to first tangent point P1; the second line segment connects vertex B to second tangent point A; vertex B is the cross point of first tangent line T1 tangent to the outer peripheral edge of cam ring 8 at first tangent point P1 and second tangent line T2 tangent to the outer peripheral edge of cam ring 8 at second tangent point A; first tangent point P1 is the tangent point between cam ring 8 and cam supporter surface 9*a* when cam ring 8 is in contact with cam ring stopper 15; second tangent point A is the tangent point between cam ring 8 and cam ring stopper 15 when cam ring 8 is in contact with cam ring stopper 15. Thus, cam ring stopper 15 has a tilt to form the obtuse angle greater than a right angle with respect to cam supporter surface 9*a*. This serves to soften a collision between cam ring 8 and cam ring stopper 15 and reduce a sound of the collision, when cam ring 8 rolling on cam supporter surface 9*a* contacts cam ring stopper 15.

Other Embodiments

The above description for the embodiment of the present invention does not limit specific configurations of the present invention to the configurations described in the above embodiment. The present invention includes variations or modifications within scope of the invention.

For example, the adapter ring may be integrally formed with the pump housing.

Each of the suction port and the discharge port may be formed only at the pressure plate or at the rear cover.

The pump device according to the present invention may be used as an oil pressure source for a hydraulic device other than the power steering device.

The following exemplifies technical ideas derivable from the above embodiment.

A pump device according to a first aspect includes: a pump housing including a pump element container space, a suction passage, a discharge passage, a suction port, a discharge port, and a cam supporter surface, wherein the suction passage is connected to the suction port, and wherein the discharge passage is connected to the discharge port; a drive shaft rotatably formed in the pump housing; a rotor that is formed with the drive shaft and includes slits; vanes each of which is disposed movably in a corresponding one of the slits; and a cam ring shaped to be annular and disposed in the pump element container space, wherein: the cam ring and the rotor and the vanes form pump chambers; the cam ring forms a first fluid pressure chamber and a second fluid pressure chamber in the pump element container space; the suction port is open to a suction region in which each of the pump chambers increases in volume with rotation of the rotor; the discharge port is open to a discharge region in which each of the pump chambers decreases in volume with rotation of the rotor; the first fluid pressure chamber is a space formed outside the cam ring in a radial direction of a rotational axis of the drive shaft, and is located such that the first fluid pressure chamber decreases in volume with increase in eccentricity of a center of an inner peripheral edge of the cam ring with respect to the rotational axis of the drive shaft; the second fluid pressure chamber is a space formed outside the cam ring in the radial direction of the rotational axis of the drive shaft, and is located such that the second fluid pressure chamber increases in volume with increase in eccentricity of the center of the inner peripheral edge of the cam ring with respect to the rotational axis of the drive shaft; the cam ring is structured to be movable in the pump element container space rollingly on the cam supporter surface, due to a pressure difference between the first fluid pressure chamber and the second fluid pressure chamber and due to a pressure of hydraulic fluid in the discharge region, without requiring a bias force from a spring to the cam ring; and the cam ring is formed such that an eccentricity-increase-side angle is constantly greater than an eccentricity-decrease-side angle within a region within which the cam ring is movable on the cam supporter surface, where: on a plane perpendicular to the rotational axis of the drive shaft, the eccentricity-increase-side angle is an angle from a first reference line to a start end of the discharge port in a direction opposite to a rotational direction of the drive shaft, where the first reference line connects a tangent point between the cam ring and the cam supporter surface to the center of the inner peripheral edge of the cam ring which is a center of the rolling movement of the cam ring; and on the plane perpendicular to the rotational axis of the drive shaft, the eccentricity-decrease-side angle is an angle from the first reference line to a terminal end of the discharge port in the rotational direction of the drive shaft.

According to a further desirable aspect in addition to the first aspect, the second fluid pressure chamber is connected to the suction passage or the suction port.

According to another desirable aspect in addition to any one of the above aspects, on a plane perpendicular to the rotational axis of the drive shaft, the cam supporter surface is formed to tilt with respect to a second reference line such that a minimum distance between the cam supporter surface and the second reference line gradually increases as followed from a side of the second fluid pressure chamber to a side the first fluid pressure chamber, where the second reference line connects the center of the rolling movement of the cam ring to a middle point between the terminal end of the discharge port and a start end of the suction port in a circumferential direction of the rotational axis of the drive shaft.

According to still another desirable aspect in addition to any one of the above aspects, the cam supporter surface is formed linearly in the direction of the rotational axis of the drive shaft.

According to still another desirable aspect in addition to any one of the above aspects, the discharge port includes a discharge port main part and a notch; the notch is shaped to extend from a start end of the discharge port main part toward a terminal end of the suction port in a circumferential direction of the rotational axis of the drive shaft, wherein the eccentricity-increase-side angle is an angle from the first reference line to a start end of the notch in the direction opposite to the rotational direction of the drive shaft.

According to still another desirable aspect in addition to any one of the above aspects, the terminal end of the discharge port is formed without a notch.

According to still another desirable aspect in addition to any one of the above aspects, the cam ring is shaped such that in a first confinement region, a minimum distance between the inner peripheral edge of the cam ring and the rotational axis of the drive shaft gradually decreases with rotation of the drive shaft, wherein the first confinement region is formed between a terminal end of the suction port and the start end of the discharge port in a space between the cam ring and the rotor.

According to still another desirable aspect in addition to any one of the above aspects, the pump housing includes a cam ring stopper, wherein: the cam ring stopper is formed to face the second fluid pressure chamber; the cam ring stopper is shaped to be in contact with the cam ring when the second fluid pressure chamber is minimum in volume; and the cam ring stopper is formed such that a minor angle out of angles interposed between a first line segment and a second line segment is an obtuse angle, where: when the cam ring is in contact with the cam ring stopper, the cam ring is in contact with the cam supporter surface at a first tangent point, and has a first tangent line tangent to an outer peripheral edge of the cam ring at the first tangent point; the cam ring is in contact with the cam ring stopper at a second tangent point, and has a second tangent line tangent to the outer peripheral edge of the cam ring at the second tangent point; the first tangent line and the second tangent line cross each other at a vertex; the first line segment connects the vertex to the first tangent point, and the second line segment connects the vertex to the second tangent point.

The invention claimed is:

1. A pump device comprising:

a pump housing including a pump element container space, a suction passage, a discharge passage, a suction port, a discharge port, and a cam supporter surface, wherein the suction passage is connected to the suction port, and wherein the discharge passage is connected to the discharge port;

a drive shaft rotatably formed in the pump housing;

a rotor that is formed with the drive shaft and includes slits;

vanes each of which is disposed movably in a corresponding one of the slits; and a cam ring shaped to be annular and disposed in the pump element container space, wherein:

the cam ring and the rotor and the vanes form pump chambers;

the cam ring forms a first fluid pressure chamber and a second fluid pressure chamber in the pump element container space;

the suction port is open to a suction region in which each of the pump chambers increases in volume with rotation of the rotor;

the discharge port is open to a discharge region in which each of the pump chambers decreases in volume with rotation of the rotor;

the first fluid pressure chamber is a space formed outside the cam ring in a radial direction of a rotational axis of the drive shaft, and is located such that the first fluid pressure chamber decreases in volume with increase in eccentricity of a center of an inner peripheral edge of the cam ring with respect to the rotational axis of the drive shaft;

the second fluid pressure chamber is a space formed outside the cam ring in the radial direction of the rotational axis of the drive shaft, and is located such that the second fluid pressure chamber increases in volume with increase in eccentricity of the center of the inner peripheral edge of the cam ring with respect to the rotational axis of the drive shaft;

the cam ring is structured to be movable in the pump element container space rollingly on the cam supporter surface, due to a pressure difference between the first fluid pressure chamber and the second fluid pressure chamber and due to a pressure of hydraulic fluid in the discharge region, without requiring a bias force from a spring to the cam ring; and the cam ring is formed such that an eccentricity-increase-side angle is constantly greater than an eccentricity-decrease-side angle within a region within which the cam ring is movable on the cam supporter surface, where:

on a plane perpendicular to the rotational axis of the drive shaft, the eccentricity-increase-side angle is an angle from a first reference line to a start end of the discharge port in a direction opposite to a rotational direction of the drive shaft, where the first reference line connects a tangent point of the cam ring and the cam supporter surface to the center of the inner peripheral edge of the cam ring which is a center of the rolling movement of the cam ring; and on the plane perpendicular to the rotational axis of the drive shaft, the eccentricity-decrease-side angle is an angle from the first reference line to a terminal end of the discharge port in the rotational direction of the drive shaft.

2. The pump device as claimed in claim 1, wherein on a plane perpendicular to the rotational axis of the drive shaft, the cam supporter surface is inclined with respect to a second reference line such that a minimum distance between the cam supporter surface and the second reference line gradually increases as followed from a side of the second fluid pressure chamber to a side the first fluid pressure chamber, where the second reference line connects the center of the rolling movement of the cam ring to a middle point between the terminal end of the discharge port and a start end of the suction port in a circumferential direction of the rotational axis of the drive shaft.

3. The pump device as claimed in claim 1, wherein the cam supporter surface is formed linearly in the direction of the rotational axis of the drive shaft.

4. The pump device as claimed in claim 1, wherein:

the discharge port includes a discharge port main part and a notch;

the notch is shaped to extend from a start end of the discharge port main part toward a terminal end of the suction port in a circumferential direction of the rotational axis of the drive shaft; and the eccentricity-increase-side angle is an angle from the first reference line to a start end of the notch in the direction opposite to the rotational direction of the drive shaft.

5. The pump device as claimed in claim 1, wherein the terminal end of the discharge port is formed without a notch.

6. The pump device as claimed in claim 1, wherein the cam ring is shaped such that in a first confinement region, a minimum distance between the inner peripheral edge of the cam ring and the rotational axis of the drive shaft gradually decreases with rotation of the drive shaft, wherein the first confinement region is formed between a terminal end of the suction port and the start end of the discharge port in a space between the cam ring and the rotor.

7. The pump device as claimed in claim 1, wherein:

the pump housing includes a cam ring stopper;

the cam ring stopper is formed to face the second fluid pressure chamber;

the cam ring stopper is shaped to be in contact with the cam ring when the second fluid pressure chamber is minimum in volume; and the cam ring stopper is formed such that a minor angle out of angles interposed between a first line segment and a second line segment is an obtuse angle, where:

when the second fluid pressure chamber is minimum in volume and the cam ring is in contact with the cam ring stopper, the cam ring is in contact with the cam supporter surface at a first tangent point, and has a first tangent line tangent to an outer peripheral edge of the cam ring at the first tangent point;

the cam ring is in contact with the cam ring stopper at a second tangent point, and has a second tangent line tangent to the outer peripheral edge of the cam ring at the second tangent point;

the first tangent line and the second tangent line cross each other at a vertex;

the first line segment connects the vertex to the first tangent point, and the second line segment connects the vertex to the second tangent point.

* * * * *